US006189451B1

(12) United States Patent
Pichler

(10) Patent No.: US 6,189,451 B1
(45) Date of Patent: Feb. 20, 2001

(54) STAMP FOR PROVIDING IMPRINT ON BULGING SURFACE

(76) Inventor: Wolfgang Pichler, Traunaustrasse 27, A-4600 Wels (AT)

( * ) Notice: Under 35 U.S.C. 154(b), the term of this patent shall be extended for 0 days.

(21) Appl. No.: 09/368,058

(22) Filed: Aug. 3, 1999

(51) Int. Cl.[7] ..... B41F 17/28; B41K 1/26

(52) U.S. Cl. ..... 101/333; 101/334; 101/DIG. 40; 101/35

(58) Field of Search ..... 101/103, 104, 101/327, 333, 334, 35, DIG. 40

(56) References Cited

U.S. PATENT DOCUMENTS

| | | | | |
|---|---|---|---|---|
| 952,501 | * | 3/1910 | Blumberg | 101/333 |
| 1,069,356 | * | 8/1913 | Tilden | 101/35 |
| 1,236,801 | * | 8/1917 | Willard | 101/35 |
| 1,814,170 | * | 7/1931 | Long | 101/35 |
| 1,992,037 | * | 2/1935 | Mulder | 101/35 |
| 3,019,762 | * | 2/1962 | Hautz | 101/35 |
| 3,948,173 | * | 4/1976 | Barasch | 101/333 |
| 6,125,747 | * | 10/2000 | Elliott | 101/35 |

FOREIGN PATENT DOCUMENTS

| | | | | |
|---|---|---|---|---|
| 25 07 855 | * | 9/1976 | (DE) | 101/35 |
| 615405 | * | 1/1926 | (FR) | 101/35 |
| 395486 | * | 7/1933 | (GB) | 101/35 |
| 424947 | * | 3/1935 | (GB) | 101/35 |

* cited by examiner

*Primary Examiner*—John S. Hilten
*Assistant Examiner*—Leslie J. Grohusky
(74) *Attorney, Agent, or Firm*—Karl Hormann

(57) ABSTRACT

A manually actuable stamp provided with first and second housing sections, one section being provided with stamping platen movable into engagement with a bulging surface and provided with a stamping surface conforming to the bulging surface when in engagement therewith, one of the first and second sections being provided with a continuous rib conforming to the contour of the bulging surface to prevent lateral slippage of the stamp thereon.

10 Claims, 4 Drawing Sheets

STAMP FOR PROVIDING IMPRINT ON BULGING SURFACE

BACKGROUND OF THE INVENTION

1. Field of the Invention

The invention, in general, relates to a manually operable stamp of the kind consisting of two sections which may be moved relative to each other between idle and operational states and, more particularly, to a stamp for placing an imprint on a bulging surface.

2. The Prior Art

Conventional stamps sized for carrying in a user's pocket cannot be used without considerable difficulty for placing imprints on bulging or convex surfaces, particularly slippery ones. Such stamps tend to slip on the surfaces leaving unpleasantly smudged or blurred imprints.

OBJECTS OF THE INVENTION

It is a primary object of the invention to provide a stamp useful for placing imprints on bulging or convex surfaces.

A particular object is to provide a stamp having a stamping platen disposed in an idle position and selectively movable into an operational or printing position in engagement with a bulging surface for providing an imprint thereon without any likelihood of lateral movement.

Another object of the invention resides in a stamp movable against the bias of a spring in a retainer into a printing position on a bulging surface.

It is also an object of the invention to provide a self-inking stamp with a support frame and stamp platen of substantially concave configuration.

It is another object of the invention to provide a stamp of the kind referred to which is provided with a stamping surface of substantially concave configuration movably disposed within a housing having an aperture substantially conforming to a bulging surface.

A further object of the invention is to provide a stamp disposed within a housing consisting of two separable sections one of which may serve as a device for securely positioning a bulging surface of an article to be stamped relative to the stamp.

Other objects will in part be obvious and will in part appear hereinafter.

SUMMARY OF THE INVENTION

In a currently preferred embodiment of the invention, there is provided a stamp provided with marginal portions which prevent movement laterally of a convex or bulging surface. Such marginal portions may be part of the printing platen of the stamp or of a housing within a cavity of which the stamp is movable between idle and stamping positions. The cavity may have an opening the margins of which are resiliently deformable. Preferably, the printing platen of the stamp assumes a concave configuration at least when it moves into engagement with a bulging surface on which an imprint is to be made, or it is configured as a concave surface ab initio.

Concave and convex as used in the context of this disclosure are intended to connote spherical and ellipsoidal configurations as well as other bulging configurations adapted to a given special purpose.

It is possible, with such a stamp to form clean imprints on spherically bulging surfaces such as, for instance, a golf ball, without the stamp surface sliding laterally thereof. In a preferred embodiment of the invention a convexly bulging stamp pad substantially complementing the concave surface of the stamp platen is provided in one of the housing portions. The stamp housing or retainer sections may be separable or they may be moved relative to each other with the stamp executing a swivelling movement between engaging the stamp pad and the surface to be stamped. The stamp pad may have a surface which is convexly bulging as such, or it may be made of a yielding material, such as, for instance, an ink-absorbing foamed polymer, which assumes a convex surface configuration when resiliently engaged by the stamp surface.

In a further embodiment of the invention one of the housing sections may be provided with a support surface at one end and, at an opposite end, with an aperture for supporting an article to be stamped. Such a housing portion may thus serve as a stand for a spherical article to be stamped.

Where the housing consists of two separable portions a seal is preferably provided between them to prevent the escape of any stamp-ink solvents. Such a seal would prevent a premature deterioration or decomposition of the stamp-ink. The seal may be constitutes by a tight fit between the housing sections or by a gasket seated in one section for engagement with a wall of the other section.

The engagement between such housing sections may be provided by a snap fit, a threaded connection, a bayonet closure, a zipper and the like.

In another embodiment of the invention the stamp may be of the so-called pre-inked kind movable between a recessed disposition within a cavity of a housing into a stamping position within an opening of the housing. The opening may either have a margin shaped to complement a bulging surface or be made of a material which will conform to the bulging surface by the application of slight pressure.

Where the stamp is of the self-inking kind the support frame of its lower section either conforms, or will conform, to the bulging surface structure of the article to be stamped.

BRIEF DESCRIPTION OF THE SEVERAL DRAWINGS

The novel features which are considered to be characteristic of the invention are set forth with particularity in the appended claims. The invention itself, however, in respect of its structure, construction and lay-out, as well as manufacturing techniques, together with other objects and advantages thereof, will best be understood from the following description of preferred embodiments when read with reference to the appended drawings, in which:

DETAILED DESCRIPTION OF PREFERRED EMBODIMENTS

Figure 1:
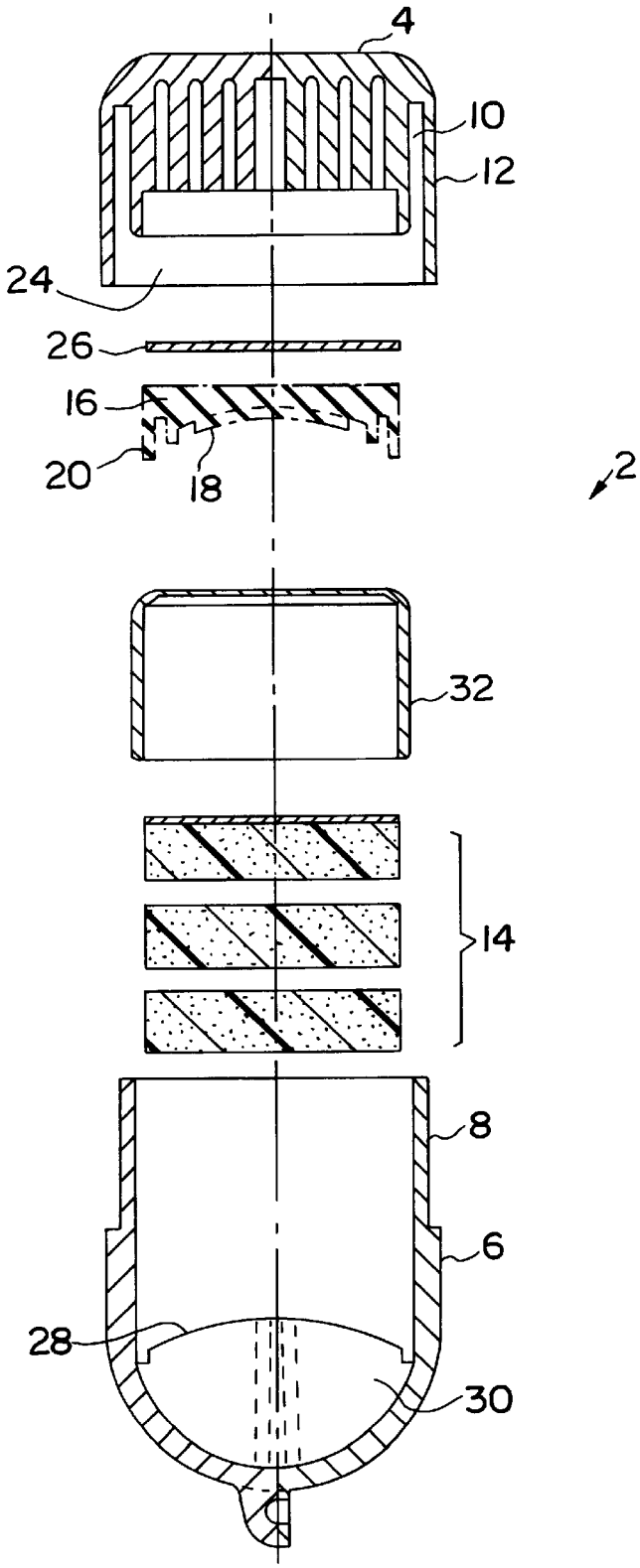
FIG. 1 is an exploded view, in axial section, of a hand stamp in accordance with the invention.

With a view to simplifying the following description like reference characters suitably primed or double-primed will be used for comparable parts of different embodiments.

Figure 2:
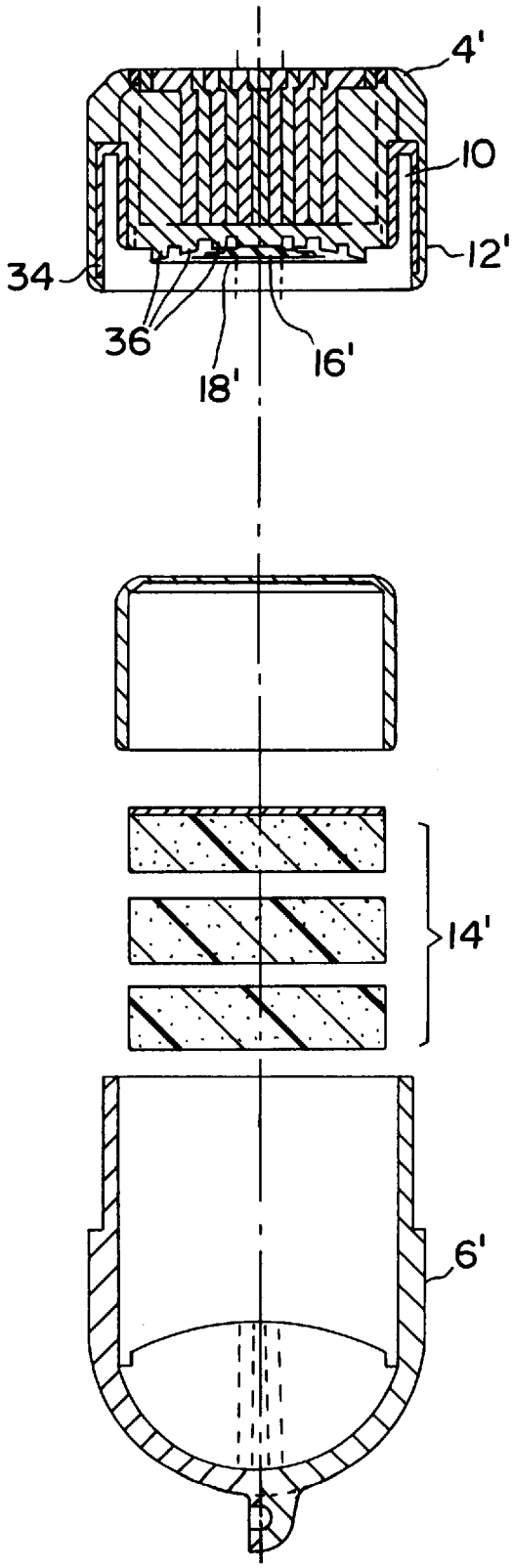
FIG. 2 is an exploded with, in axial section, of another hand stamp in accordance with the invention.

A hand stamp 2 depicted in FIGS. 1 and 2 consists of two substantially cylindrical housing sections 4 and 6 made of a suitable material such as metal or plastic. The housing sections 4 and 6 may by axial movement be separated from each other (as shown) or they may be put together such that a lip 8 extending from housing section 6 is seated in a complementary recess 10 adjacent to an outer lip 12 of housing section 4. The lip 8 or the recess 10 may be provided with a gasket, or they may be provided with matching threads, close, snap or bayonet fits (neither shown) to prevent evaporation of ink solvent and premature decomposition of any ink contained within the stamp 2 as will appear hereinafter. While a treble-layer stamp pad 14 for storing such ink is shown to be part of the lower housing section 6 to provide ink for a stamp platen 16 seated in the upper housing section 4, it will be understood by those skilled in the art that the stamp 2 may be of the pre-inked type in which case there would be no stamp pad 14 in the lower housing section, and the stamp platen 16 in the upper housing section would instead be made of a material saturated with ink as is well known in the art.

The stamp platen 16 is shown to have a stamping surface 18 of concave configuration and is preferably made of a resilient material such as rubber or another suitable polymer. The platen 16 is provided with a peripheral lip 20. In order to provide an imprint on a bulging surface 22 (FIG. 3), the lip 20 is placed against it. The lip 20 may either be configured to complement the bulging contour of the bulging surface 22, or it may be conformed to that contour by slight pressure on the stamp platen 16 by way of the upper housing section 4. The engagement of the lip 20 with the bulging surface 22 is such as to prevent any lateral movement of the platen 16 relative to the surface 22 and thus ensures a clean imprint thereon. To this end the lip 20 is advantageously made of a material having a high friction coefficient. The platen 16 may be secured in an axial recess 24 in the housing section 4 by adhesive tape 26 or the like.

The treble-layered stamp pad 14 is disposed upon convexly bulging radial ribs 28 or the like disposed within a recess 30 of the lower housing section 6. A lock ring 32 is provided for securing the layers of the stamp pad 14 against unintentional removal while at the same time imparting to them the convexly bulging configuration of the ribs 28. The convex upper surface of the stamp pad 14, in its assembled state, substantially conforms to the concave configuration of the surface 18 of the stamp platen 16.

The treble layers of the stamp pad 14 result in an extended service life of the stamp 2 as they can absorb more ink than would otherwise be possible.

In the embodiment shown in FIG. 2 a free margin 34 of the outer lip 12'0 of the housing section 4' constitutes an engagement member not unlike the lip 12 of the embodiment of FIG. 1. To this end, the upper housing section 4' of this embodiment is preferably made of a resiliently flexible material, such as a suitable polymer for instance, so that, if necessary, the margin 34 may conform to the shape of a bulging surface to be provided with an imprint. The stamp platen 16' is seated on and suitably connected to a plurality of ribs 36 the free ends of which form a convex support for the stamp platen 16'. The configuration of the stamping surface 18' may be concave or planar. If it is planar the platen 16' is preferably made of a resiliently compressible material capable of conforming to the configuration of a bulging surface 22 to be provided with an imprint.

Figure 3:
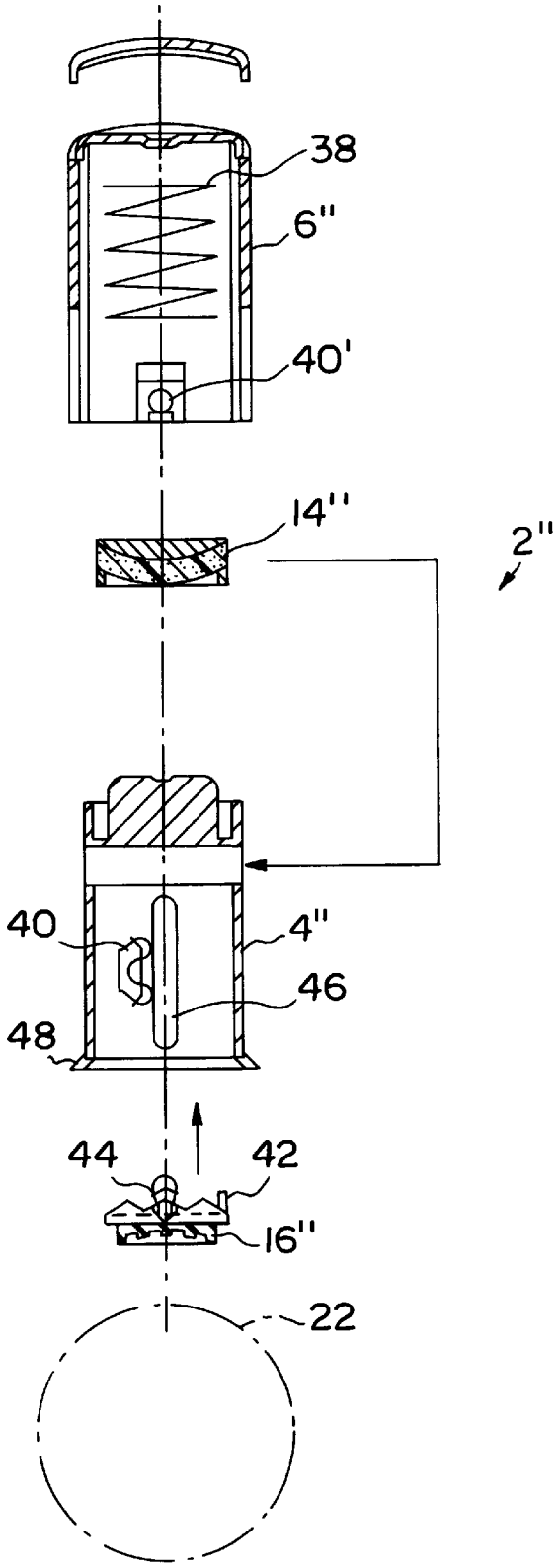
FIG. 3 is an exploded view of components of a self-inking stamp in accordance with the invention.
Figure 4:
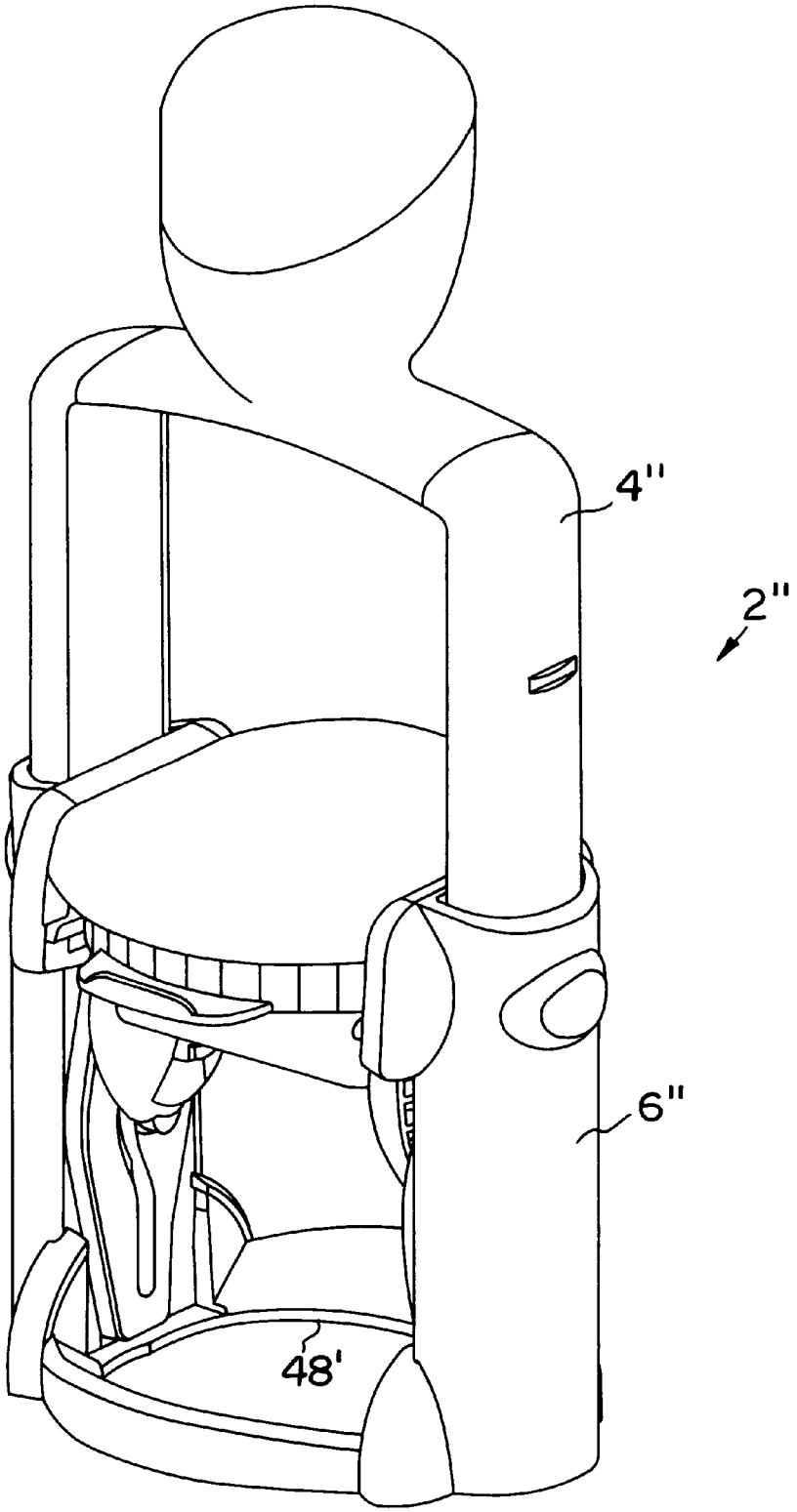
FIG. 4 is a perspective view of a self-inking stamp provided with a frame shaped to conform to a bulging surface.

FIG. 3 is an exploded view of parts of a self-inking stamp 2" of the kind shown in an assembled state in FIG. 4. In this embodiment, housing portion 6" contains a pressure spring 38 and functions as a guide for the housing section 4". The housing section 4" receives a stamp pad 14" in the usual manner. However, as shown the outer surface of the stamp pad 14" is of bulging configuration. As schematically shown, the housing section 4" is additionally provided with certain parts of a swivelling mechanism 40 for a movable concave stamping platen 16" the support 42 of which is slidably supported by pins 44 in vertical guide slots 46 in the housing section 4". The pins 44 are received in journals 40' in the housing section 6". The journals 40' constitute further parts of the swivelling mechanism 40 which operates whenever the housing sections 4" and 6" are moved relative to each other by swivelling the platen 16" from an idle state in engagement with the stamp pad 14" to an printing position in engagement with bulging surface 22. A free margin 48 of the lower housing section 6" is either made of a resiliently deformable material or has a curved inner rim 48' as shown in FIG. 4 to conform to the contour of a bulging surface.

The embodiments herein shown will be understood by those skilled in the art as being merely representative of many other possible structures providing appropriate engagement between a stamping platen and a bulging surface and preventing slippage of the stamp while in operation.

What is claimed is:

1. A manually actuable stamp for providing an imprint on a bulging surface, comprising:

a housing comprising first and second sections axially movable relative to each other between an idle state and an operational disposition of one of the first and second housing sections relative to the bulging surface, the first and second sections each having an open end adapted to internest with one another in the idle state and a substantially closed opposite end;

means for forming a stamping platen in one of the first and second sections provided with a stamping surface; and means surrounding the platen for forming a lip resiliently engaging the bulging surface in the operational disposition.

2. The stamp of claim 1, wherein one of the first and second housing sections supports the stamp platen for swivelling movement about an axis parallel to its plane and is slidably connected to the other of the first and second housing sections, the other housing section being provided with means for swivelling the platen during movement between the idle state and the operational disposition.

3. The stamp of claim 1, wherein the stamping surface is axially movable relative to the lip.

4. The stamp of claim 1, wherein the lip is mounted on the platen to circumscribe the stamping surface.

5. The stamp of claim 1, wherein the open end of the one of the first and second sections is provided with a resiliently deformable free margin forming the lip.

6. The stamp pad of claim 1, wherein a stamp pad is provided in the other of the first and second sections for engaging the printing surface when the first and second sections are in their idle state.

7. The stamp of claim 6, wherein the open end of the other of the first and second housing sections comprises a support for an article provided with the bulging surface to be stamped.

8. The stamp of claim 1, wherein the stamping platen is made of a resiliently compressible material and the stamping surface conforms to the bulging surface when moved into engagement therewith.

9. The stamp of claim 1, wherein the stamping surface is of substantially concave configuration.

10. The stamp of claim 1, further comprising means providing a seal between the first and second housing sections in their idle state.

* * * * *